US006598783B2

(12) United States Patent
Brinkman

(10) Patent No.: US 6,598,783 B2
(45) Date of Patent: Jul. 29, 2003

(54) PARCEL AND OBJECT MARKING AND METHOD

(76) Inventor: Tom Brinkman, 1573 N. Tenth Ave., Pensacola, FL (US) 32503

( * ) Notice: Subject to any disclaimer, the term of this patent is extended or adjusted under 35 U.S.C. 154(b) by 157 days.

(21) Appl. No.: 09/780,832

(22) Filed: Feb. 9, 2001

(65) Prior Publication Data

US 2001/0006090 A1 Jul. 5, 2001

Related U.S. Application Data

(63) Continuation-in-part of application No. 08/957,238, filed on Oct. 24, 1997, now abandoned.

(60) Provisional application No. 60/181,250, filed on Feb. 9, 2000.

(51) Int. Cl.[7] ..... B65D 5/62; B65D 25/34

(52) U.S. Cl. ..... 229/116.1; 40/312; 206/459.5; 229/921

(58) Field of Search ..... 229/116.1, 92.8, 229/921; 206/457, 459.5; 40/312

(56) References Cited

U.S. PATENT DOCUMENTS

| | | | | | |
|---|---|---|---|---|---|
| 96,108 | A | | 10/1869 | Hendrickson | |
| 185,727 | A | * | 12/1876 | Collins | 206/459.5 |
| 1,001,304 | A | | 8/1911 | Riley | |
| D57,337 | S | | 3/1921 | Heimerdinger | |
| 1,896,812 | A | | 2/1933 | Drew | |
| D92,563 | S | | 6/1934 | Sickel | |
| 1,994,673 | A | | 3/1935 | Steinthal | |
| 2,067,998 | A | | 1/1937 | Williamson | |
| 2,114,052 | A | | 4/1938 | Kincade, Jr. | |
| RE21,706 | E | * | 2/1941 | Claff | 493/55 |
| 2,307,406 | A | * | 1/1943 | Howard | 206/459.5 |
| 2,342,623 | A | | 2/1944 | Aquino | |
| 2,483,464 | A | | 10/1949 | Johnson | |
| 2,789,689 | A | * | 4/1957 | Lewis | 206/459.5 |
| 2,967,655 | A | | 1/1961 | Seger, Jr. | |
| 3,003,680 | A | | 10/1961 | Wilcox, Jr. | |
| 3,040,958 | A | | 6/1962 | Hagan | |
| 3,126,143 | A | | 3/1964 | Hagan | |
| 3,155,234 | A | | 11/1964 | Knoll et al. | |

(List continued on next page.)

FOREIGN PATENT DOCUMENTS

| | | |
|---|---|---|
| DE | 2221791 | 11/1973 |
| DE | 4028276 | 3/1992 |
| GB | 2263275 | 7/1993 |
| JP | 2282076 | 11/1990 |

*Primary Examiner*—Gary E. Elkins

(57) ABSTRACT

Objects, such as packages are marked for exterior labeling and to provide for easily locating such information. In a first embodiment, an information focal edge, or IFE is made by graphically "capturing" at least two corners of the object and connecting them with a marking, e.g., with ink. By "capturing" it is meant that the corner is marked on all sides forming the corner adjacent to the corner. In an alternative embodiment, two corners are captured using a structural edge or by otherwise marking an edge, thereby providing an "information focal edge," or IFE. The IFE identifies a priority location where information should be placed so that it can be quickly found no matter how the object is viewed.

15 Claims, 11 Drawing Sheets

U.S. PATENT DOCUMENTS

| | | | | | |
|---|---|---|---|---|---|
| 3,335,938 | A | * | 8/1967 | Kramer | 40/312 |
| 3,361,329 | A | | 1/1968 | Fox | |
| 3,568,917 | A | | 3/1971 | Vergobbi | |
| 3,610,514 | A | | 10/1971 | Samsing | |
| 3,681,160 | A | * | 8/1972 | Richie et al. | 40/312 |
| 3,776,410 | A | | 12/1973 | Carlson | |
| 3,858,717 | A | * | 1/1975 | Peters | 206/459.5 |
| 3,916,160 | A | | 10/1975 | Russo et al. | |
| 4,136,542 | A | | 1/1979 | Robison | |
| 4,204,639 | A | * | 5/1980 | Barber et al. | 40/359 |
| 4,283,001 | A | | 8/1981 | Meyers | |
| 4,545,780 | A | * | 10/1985 | Martin | 493/11 |
| 4,688,716 | A | | 8/1987 | Winterling | |
| 5,029,709 | A | | 7/1991 | Faulstick | |
| D329,806 | S | | 9/1992 | Kindt | |
| D337,270 | S | | 7/1993 | Brockman | |
| 5,290,066 | A | | 3/1994 | Mody | |
| 5,421,948 | A | | 6/1995 | Crankshaw et al. | |
| D384,883 | S | | 10/1997 | Wood | |
| D395,004 | S | | 6/1998 | Shamoon | |
| 5,789,049 | A | | 8/1998 | Randles | |
| 6,090,027 | A | * | 7/2000 | Brinkman | 493/54 |

* cited by examiner

PARCEL AND OBJECT MARKING AND METHOD

This application is a continuation in part of application 08/957,238 filed Oct. 24, 1997 now abandoned. This application is based upon, and claims the benefit of, U.S. Provisional Patent Application No. 60/181,250 filed on Feb. 9, 2000, which is herein incorporated by reference.

BACKGROUND

The marking of a parcel for shipment or inventory in the past has traditionally involved random marking by means of single or multiple labels positioned to be visible on one or multiple sides of a box parcel having six sides. Some labels have more than one portion, or billboard, each serving a different purpose or providing different information. While some attention has been paid to develop multiple billboard designs, they are typically applied to the center of a single side and are sometimes saddled over a single edge between corners. For some time now, manufacturers and parcel shippers have allowed random placement of labels, so there is no location on a parcel where one can readily expect to find the pertinent information.

The difficulty in quickly finding desired labels on the parcel is compounded because a parcel's lifecycle presently requires dice-like repeated flipping and rotation of each parcel in the warehouse, transportation vehicle, loading dock, and parcel delivery center. As a parcel continues to move from the production facility or other point of origin down the belts to be routed onto the proper paths for delivery trucks, for what may be one of several delivery events, and then into warehouses after delivery, a parcel will continue to require the same repetitious and repeated rotational labor to find the most current or applicable label of value to meet the needs of the handler. Such a label will generally indicate the parcel's direction toward the consumer or other recipient with stops at distribution centers and stores, urgency in terms of delivery date, storage conditions, radio frequency identification (RFID) devices, location of and/or contents information otherwise coded. Each time a parcel is handled so that a label can be scanned or read for sorting, the difficulty in finding the desired label adds a significant amount of time to the processing of that parcel over its lifecycle.

Currently, time-critical information markings, such as delivery urgency, as well as markings regarding shelf life and storage conditions, are frequently positioned indiscriminately rather than purposefully, or are difficult to locate and then understand by consumers or other inexperienced persons having a need to know.

All current inventory, merchandise, or parcel labels are known to suffer from a number of disadvantages, including wasted time in finding a label on a parcel since traditional shipping labels are visible on only one side of a parcel. This is especially evident when observing checkout in a grocery store as the cashier will be seen rotating for a scan of a barcode applied in random positions about the hundreds of thousands of different parcels. Then, the purchaser will frequently be rotating to view instructions for preparing and nutritional information again applied at random.

Also, the random application of a required hazardous materials, storage condition, food dating, or "Fragile" label to a parcel's side, perhaps not adjacent to the address label on a parcel in transit, will increase likelihood of an accident and/or financial loss. For example, if a parcel label indicating hazardous contents is affixed to the top of a parcel and thereafter becomes hidden from view and due to the dice-like flipping and rotating nature of parcel handling, the label may never be seen or hidden from view when stacked. This improper labeling or a failure to see a hazardous contents label can cause dangerous storage conditions in warehouses and during one of the parcel's transportation events. This unacceptable risk may be responsible for causing personal injury, environmental pollution, warehouse storage site damage, aircraft, ship, truck, or other transportation vehicle damage, as well as toxic reactions, death, or fire.

Prior-art parcel labels featuring multiple billboard segments are designed to only expose only the address. However, persons may need to apply or locate additional information on a parcel. This additional information may be related to: directions about address on parcels, delivery urgency, contents, declared hazardous materials, bar-codes, 2D bar-codes, RFID's, instruction to the consumer, storage conditions, , model numbers, serial numbers, critical shelf life, green-directions for safe environmental disposal, or time dated for safe usage or disposal of said materials.

SUMMARY

The above-discussed disadvantages are overcome by an improved method of marking an object, such as a parcel, for exterior labeling and then provides for easily locating such information in a manner that anyone can quickly find. In a first embodiment, an object is marked by capturing at least two corners of the parcel and connecting them by ink. In alternative an embodiment, the two corners are captured using a structural edge or by otherwise marking an edge, thereby providing an information focal edge, or IFE. Applying an IFE to a parcel identifies a location on the object where information and labels should be located so that they can be quickly found no matter how the object is viewed.

DETAILED DESCRIPTION OF THE PREFERRED EMBODIMENTS

Parcels come in various shapes and sizes. Commonly, parcels include flat envelope parcels, six-sided box parcels, and elongated tubular parcels having various cross sections such as a triangular or circular cross section.

By providing a parcel with an Information Focal Edge (IFE), a specific region is designated to locate information as to the direction, urgency, and/or (DUC) contents. This location is referred to herein variously as a "priority location", "priority corner", "priority side", or "priority region." When DUC information is positioned at a priority location, the information may be quickly located by handling personnel. The cumulative effect will be to significantly reduce handling time thereby increasing the productivity of handling personnel.

In a first embodiment of the invention, an IFE is formed by "capturing" at least two corners of the parcel and connecting them by ink markings. By "capturing" it is meant that all sides forming the corner are marked adjacent to the corner. In alternative embodiments, the two corners are captured using a structural edge or by otherwise marking an edge, thereby providing an IFE. In the case of a structural edge, there is no ink marking, the corners instead being identified by a unique structure of the parcel.

Embodiment 1

Figure 1A:
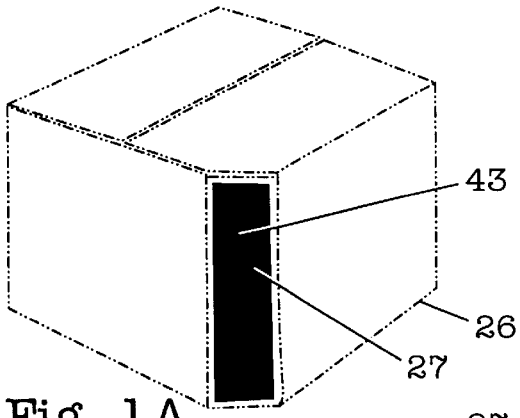
FIG. 1A shows a perspective view of a vertical structural formed IFE (Information focal edge) on a substrate of a box parcel.

FIG. 1A shows a perspective view of a box parcel 26 having a lateral structural expansion of the vertical edge to form a seventh side that is referred to as an Information Focal Edge (IFE) 27. The Seven sided box parcel while shown generically as a box with a dash-dot-dot-dash line formation is suggestive of any size or shape of a box or object where a priority area 43 is available as a central location for placement of any information. For example, DUC information may be provided on or adjacent to priority area 43 either with direct imprint or as an applied label.

Figure 6A:
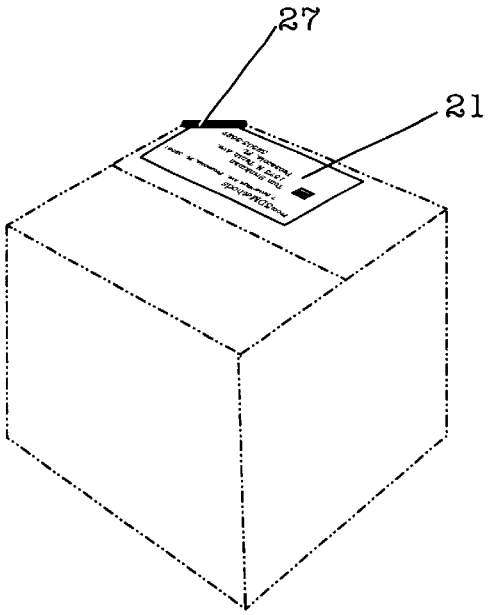
FIGS. 6A and 6B show a perspective rear and front views, respectively, of an exemplary application of the structural IFE of FIG. 1A.
Figure 6B:
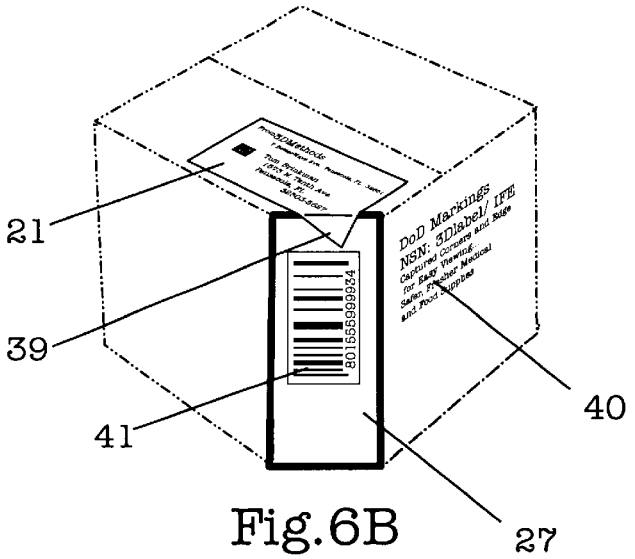

When viewing box parcel 26 having structural IFE 27 any bias view having three sides this embodiment provides for a clue as to the location of information. FIGS. 6A and 6B show an exemplary box parcel having a structural IFE 27 with exemplary labelings and markings. Specifically, FIG. 6A shows a rear bias view (top and two sides, right and left) of this parcel where an exemplary traditional label 21 is applied over an edge of structural IFE 27. FIG. 6B shows a front bias view of parcel of 6A rotated to view traditional label 21 folded over an edge of structural IFE 27 to now form by its presence at what will be recognized as a top giving priority corner 39 for a placement of additional information such as exemplary barcode label 41. Also shown by way of example is Department of Defense (DoD) markings 40 according to DoD regulations and placed adjacent structural IFE 27.

Figure 6C:
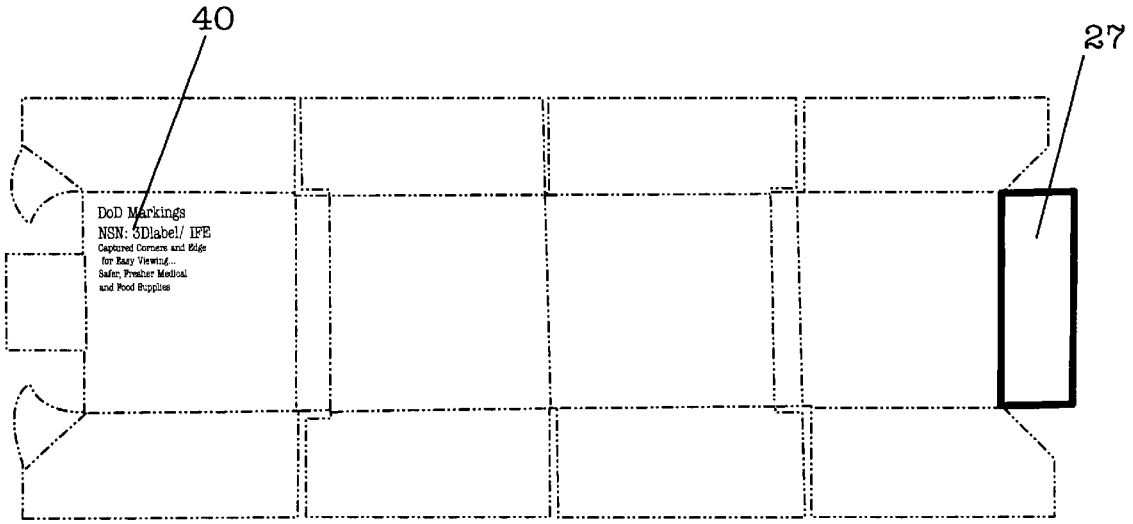
FIG. 6C shows a plan view of an exemplary construction of the parcel box of FIGS. 6A and 6B.

A top plan view of a box parcel prior to assembly having a structural IFE is shown in FIG. 6C. Ink labeling printed may directly printed on the substrate as information is pre-positioned to align itself in an adjacent but connected manner to structural IFE 27 as a priority corner of the parcel when formed to fill and transfer. Such markings are shown in FIG. 6C as exemplary DoD markings 40 similar to that shown in assembled box parcel of FIG. 6B.

Figure 1B:
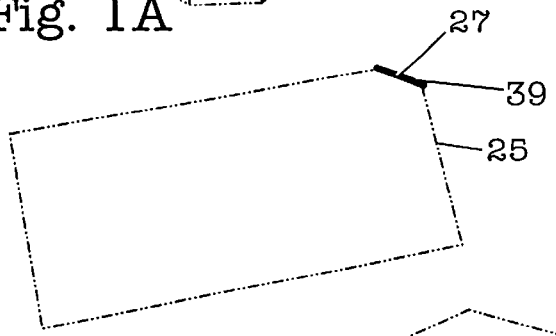
FIG. 1B shows a perspective view of a structural formed IFE on a substrate of a merchandise object or envelope parcel.

FIG. 1B shows a substantially flat object 25 with IFE 27 having a priority corner 39 for placing labels and imprinting information determined by the needs of the users. When viewing this object in all possible rotations on each side, the location of information placed on a structural marked corner is immediately determinable. A good example of use for this object would be for a substantially flat merchandise parcel with a bubble pack of merchandise is attached to a card. This would allow a maker to locate a barcode for scanning and instructions aligned to this as a priority corner. Additionally it provides for persons who are visually-challenged to react with a structurally marked object for placement and scanning at checkout to locate a barcode.

Embodiment 2

In a second embodiment of the invention, an IFE is formed of ink on a parcel or object. So that the priority location can be readily determined, a parcel or object is marked from a first corner of the parcel to a second corner of the parcel. The marking captures both corners, and may be scalar, i.e., not indicating a direction, or it may a vector, so that the marking effectively points to a priority location at one of the captured corners. The IFE should not have more than one priority location per parcel or its purpose is defeated for having a central location where all information may be placed for easy viewing.

Figure 2A:
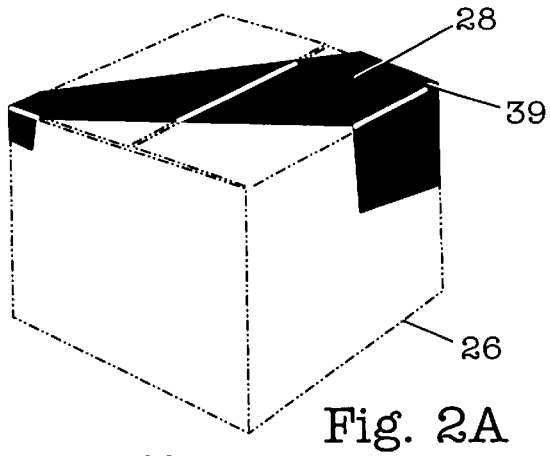
FIG. 2A shows a perspective view of an ink diagonal formed IFE on a box parcel.
Figure 4I:
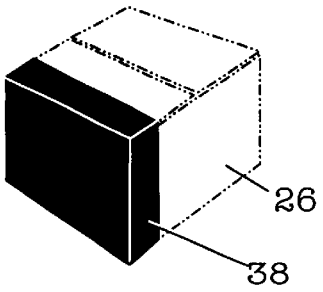
FIG. 4I shows a perspective view of an ink formed IFE capturing four corners and a single side for placement and location of information.

For example, FIG. 2A shows a parcel box 26 or object where ink has been applied to form diagonal vector IFE 28 formed of ink capturing two corners across a top face of parcel box 26. It should be recognized that, while IFE 28 is formed across the top face of parcel box 26, it may be formed across any face of parcel box 26. Diagonal vector IFE 28 points to priority corner 39 where any information may be first placed and then easily located by others during the parcel's lifecycle. FIG. 4C shows another example of a parcel box 26 having a diagonal vector IFE 32 formed of ink in with a different orientation of the than diagonal IFE 28 of FIG. 2A. In each case, the diagonal vector IFEs capture two corners across a side face of a parcel, and effectively point to a priority corner by indicating direction.

In the examples shown herein, the direction is indicated by showing the IFE having outer boundaries that are non-parallel. The priority area is the pointed to by following the IFE in the direction in increasing width of the IFE. Other means of indicating direction are contemplated. For example, the IFE may be formed by a chevron pattern or other direction-indicating pattern. Alternatively, the color of the IFE may vary from one captured corner to the priority corner. For example, using half-tone techniques or otherwise, the saturation color may be increased in the direction of the priority location.

Figure 5I:
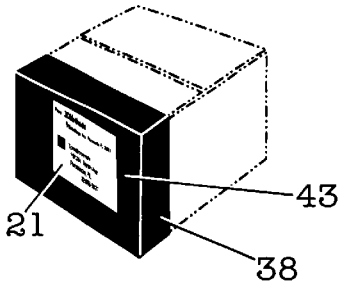
FIGS. 5A, 5B, 5C, 5D, 5E, 5F, 5G, 5H, and 5I show exemplary applications of IFEs of FIGS. 4A, 4B, 4C, 4D, 4E, 4F, 4G, 4H, and 4I, respectively.
Figure 5B:
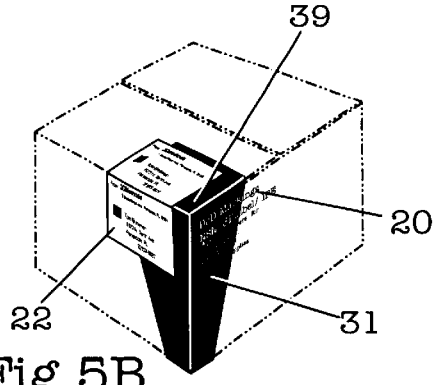
Figure 5C:
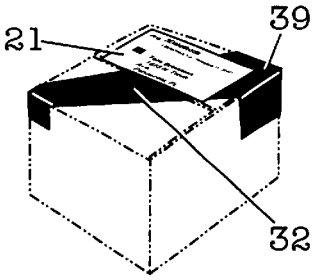

FIGS. 5C, shows diagonal IFE 32 with exemplary traditional label 21 which is applied to the top side adjacent to diagonal IFE 32 having a priority corner 39 as shown.

Figure 2B:
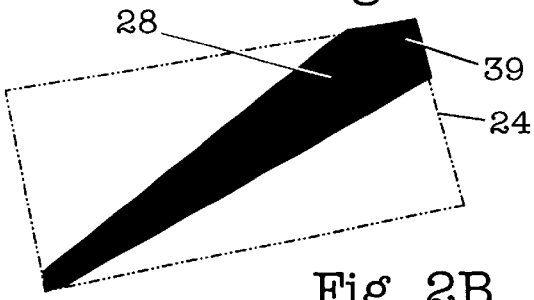
FIG. 2B shows a perspective view of an ink diagonal formed IFE on a merchandise object or envelope parcel.

This example can be applied to a flat parcel or object such as an envelope as shown in FIG. 2B. Here, an envelope parcel 24 has ink printed on it to form a diagonal IFE 28 forming a priority corner 39 where any information may be first placed and then easily located by others during the parcel lifecycle.

Figure 8A:
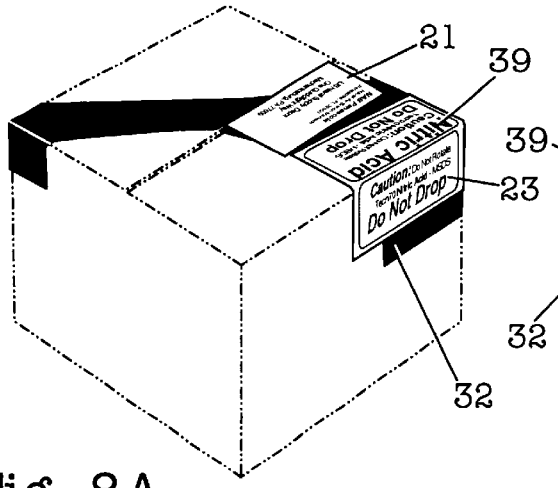
FIGS. 8A and 8B show a top and bottom perspective views, respectively, of another exemplary application of the vector IFE of FIG. 2A.
Figure 8B:
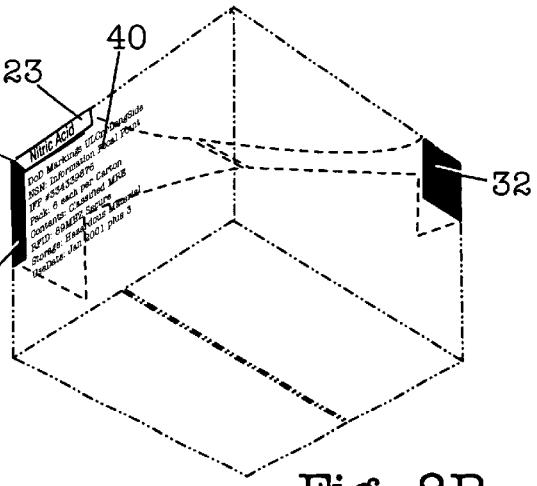
Figure 14:
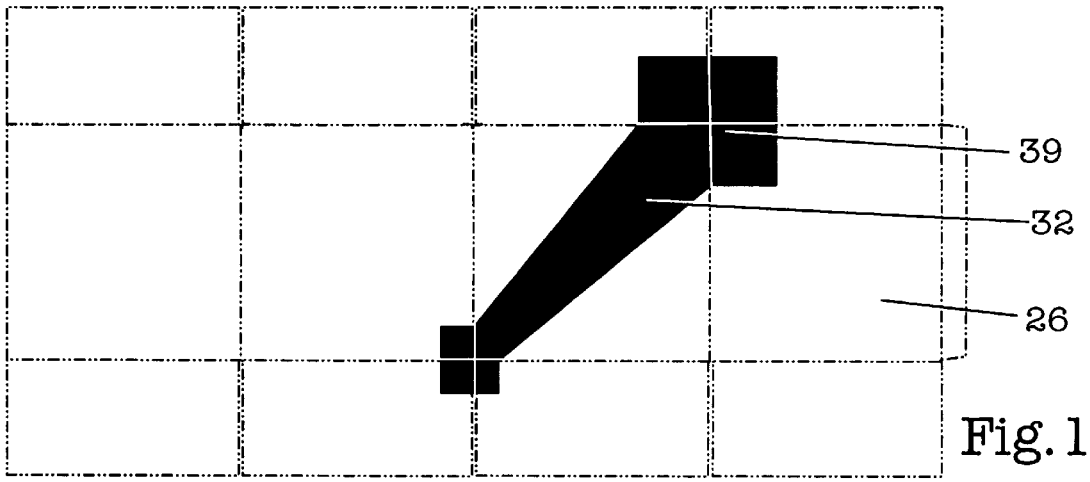

FIGS. 8A and 8B show another exemplary application of a diagonal IFE 32. Here, a traditional address label 21 and a corner label 23 are applied to priority corner 39 identified by diagonal IFE 32. A plan view of an example of an unassembled box parcel 26 having diagonal vector IFE 32 imprinted thereon is shown in FIG. 14. Diagonal vector IFE 32 remains unchanged regardless as to how the flaps are folded during the parcel lifecycle. Diagonal IFE 32 remains unchanged regardless as to how the flaps are folded during the parcel lifecycle.

Figure 3A:
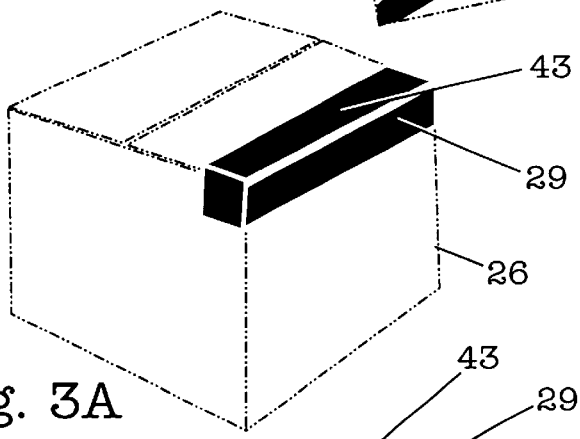
FIG. 3A shows a perspective view of a tape formed horizontal IFE on a box parcel.
Figure 3B:
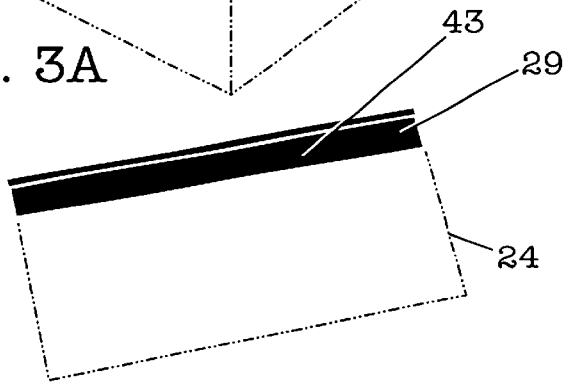
FIG. 3B shows a perspective view of a tape formed IFE on a envelope parcel.

FIGS. 3A and 3B show examples of scalar IFE 43 formed along one edge of a parcel or object. The term "scalar" is used to indicate that the IFE is non-directional, i.e., it merely indicates an edge but does not point to a particular corner as being the priority location as does the vector IFEs described above. An advantage of the scalar IFE is that it can be formed of tape and applied to the parcel rather than printed thereon. Alternately, a priority corner may be formed by use of graphical indications such as chevrons or a change in color on the tape substrate.

FIG. 3A shows a parcel box 26 where a scalar IFE 29 formed by a secondary substrate such as adhesive tape designates priority area 43 where any information may be applied and later quickly found.

Figure 4B:
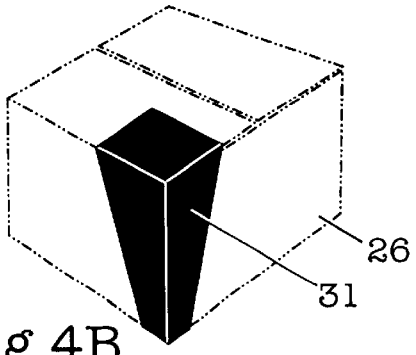
FIG. 4B shows a perspective view of a vertical ink formed IFE as an edge formed of non-parallel lines as a vector, having direction as well as magnitude, providing for placement of any information at a single priority corner.
Figure 4C:
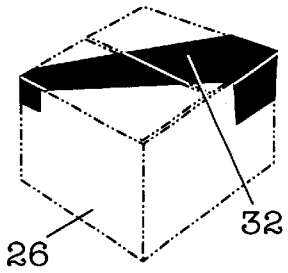
FIG. 4C shows a perspective view of a diagonal ink formed vector IFE as formed without aligning to a structural edge to indicate a single priority corner.
Figure 4H:
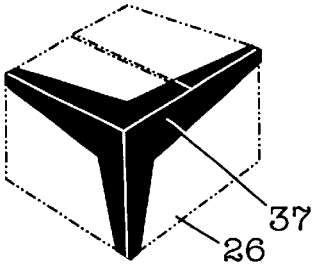
FIG. 4H shows a perspective view of an ink formed tri-vector IFE connecting four corners to a central corner with their common edges.
Figure 4A:
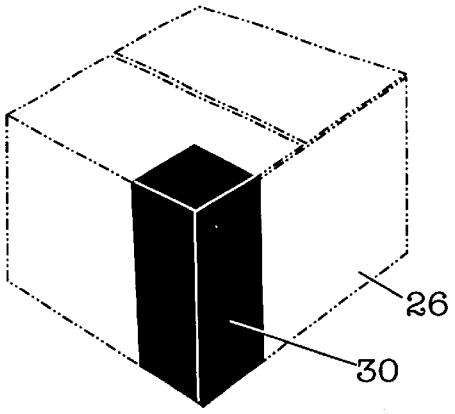
FIG. 4A shows a perspective view of a vertical ink formed IFE as an edge formed of parallel lines as a scalar, having magnitude, capturing two corners of a box parcel.

It is also within the scope of this embodiment that the scalar IFE may be formed of ink and along a vertical edge of parcel box 26 as shown in FIG. 4A. Here, parcel box 26 has a scalar vertical IFE 30 formed of ink capturing two corners along a structural edge of said parcel with scalar IFE formed of parallel boundaries. FIG. 5A shows parcel box 26 of FIG. 4A with an exemplary corner label 23 folded around a corner making it a priority corner 39 by capturing one of the two corners of scalar vertical IFE 30.

Figure 12:
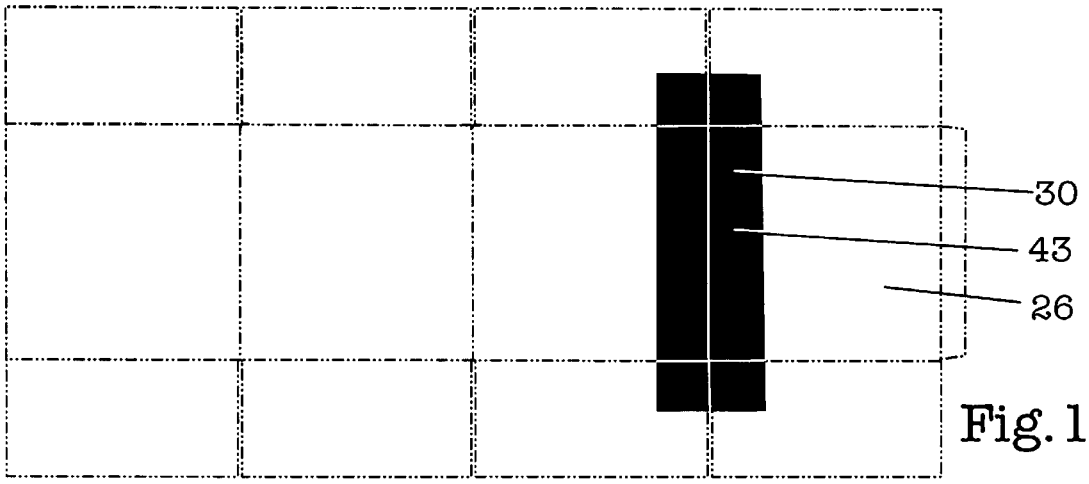
FIGS. 12, 13, 14, 15, 16, 17, 18, 19, and 20 each show a plan view of an unassembled box used to form that shown in FIGS. 4A, 4B, 4C, 4D, 4E, 4F, 4G, 4H, and 4I, respectively.

Vertical scalar IFE 30 may be formed by printing ink directly on the substrate of parcel box 26 prior to assembly as shown in FIG. 12, which shows a plan view suggesting a layout for a box parcel 26 and vertical scalar IFE 30 formed of ink providing priority area 43.

A scalar IFE 29 formed of tape can also be applied to a flat object or parcel such as an envelope as shown in FIG. 3B. Scalar IFE 29 designates priority area 43 which is adjacent to or on top of the scalar IFE 29.

Figure 11A:
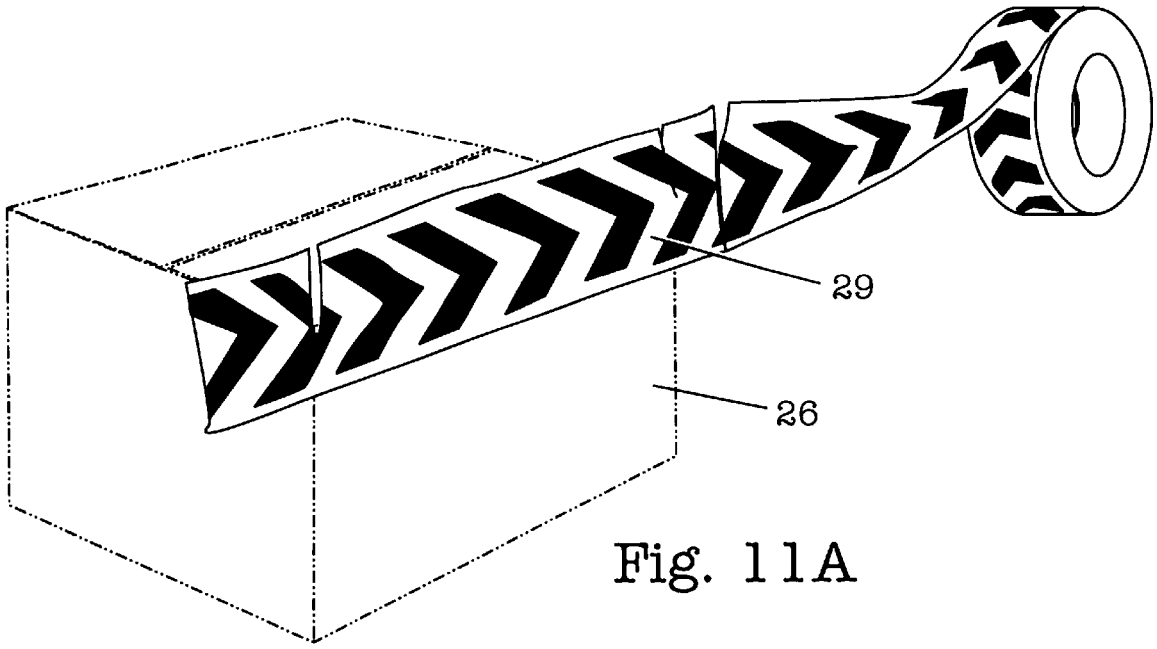
FIG. 11A shows a top perspective view of a box parcel with IFE tape being applied in along horizontal edge capturing two corners.
Figure 11B:
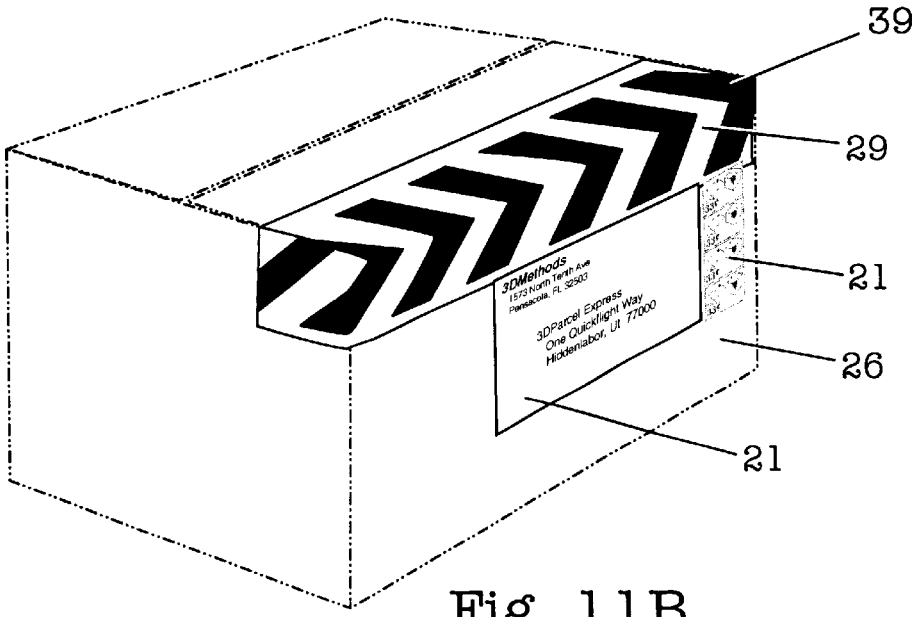
FIG. 11B shows the box parcel of FIG. 11A with the IFE tape applied and showing exemplary placement of labels adjacent to a priority corner.

Adhesive tape may also be used to create a vector IFE as shown in FIGS. 11A and 11B. FIG. 11A shows box parcel 26 during an application of a vector IFE tape 29. Vector IFE tape 29 includes a graphical device, in this case a chevron design, marking of ink applied thereto providing direction along a horizontal edge captured by the tape. FIG. 11B shows the same view of a box parcel 26 as described in FIG. 11A. For purposes of illustration only, FIG. 11B shows traditional address label 21 applied to a side of box parcel 26 along with postal stamps 21.

The remaining examples of the second embodiment will now be briefly described as they do not significantly depart from the description above except as clearly shown in the drawings.

A vertical vector IFE 31 is shown in FIGS. 4B, 5B, 7C, 7D, and 13. FIG. 4B shows a parcel box 26 having a vertical vector IFE 31 formed of ink capturing two corners along a vertical structural edge of parcel box 26. Parcel box 26 is shown in FIG. 5B with saddle like label 22 applied over an edge. Also for purposes of illustration only, indicia are shown here for simulation of a DoD marking in the upper left corner of a long side which may be applied during the manufacturing of parcel box 26.

Figure 7A:
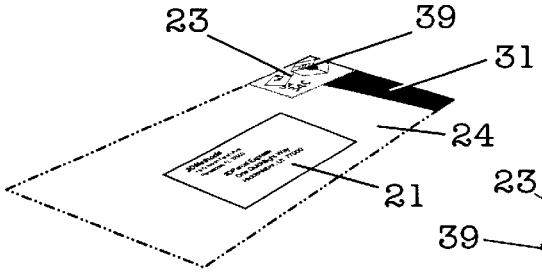
FIGS. 7A and 7B show a top and bottom perspective views, respectively, of an envelope parcel having a vertical vector IFE formed of ink.
Figure 7B:
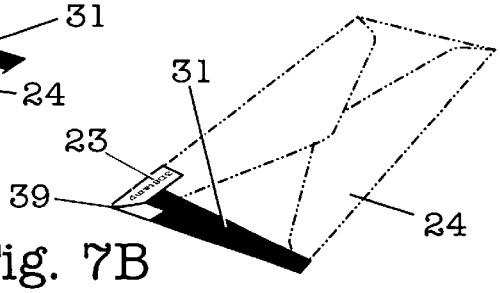
Figure 7C:
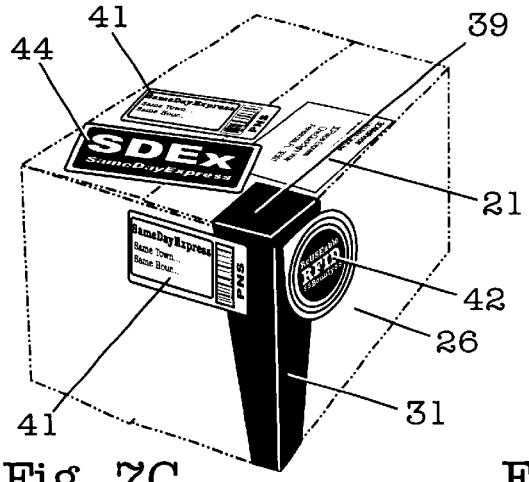
FIGS. 7C and 7D shows a front and bottom perspective views, respectively, of another exemplary application of vertical vector IFE of FIG. 4B.
Figure 7D:
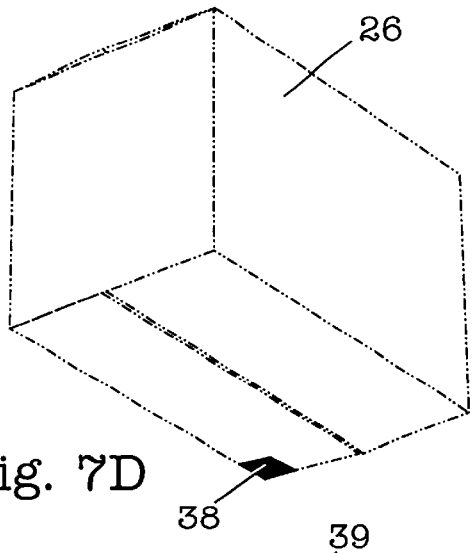
Figure 13:
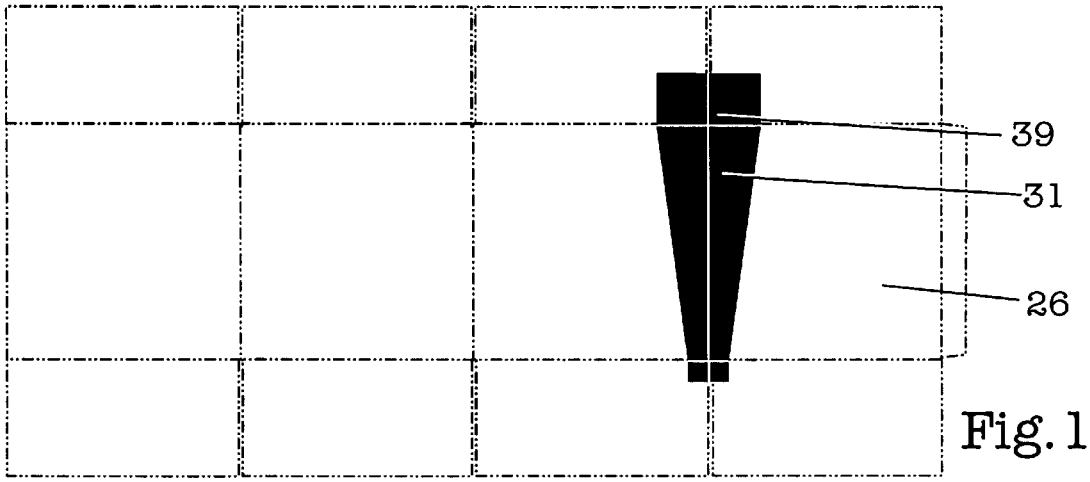

FIG. 7C and 7D show another exemplary application of box parcel 26 having a vertical vector IFE 31. Here, multiple labels are shown applied in an adjacent manner to priority corner 39. The various label types are shown to include: a traditional label with address information 21, a service provider label 44 with delivery service information for an imaginary company, several duplicate barcode labels 41 on a top and end of carton to be viewable when stacked, a Radio Frequency Identification (RFID) label 42 that is positioned adjacent to the priority end of vertical vector IFE 31 for easy location to scan and easy retrieval for reuse. A plan view of an example of an unassembled box parcel 26 having a vertical vector IFE 31 imprinted thereon is shown in FIG. 13. Vertical vector IFE 31 remains unchanged no matter how the flaps are folded during the parcel lifecycle.

Vertical vector IFE 31 is also appropriate in flat objects or parcels, such as envelopes shown in FIGS. 7A, 7B, 7E, and 7F. FIGS. 7A and 7B show a first exemplary application of a vertical vector IFE 31 applied to an envelope parcel 24. Here, a stamp 23 and traditional address label 21 are applied to priority corner 39 identified by vertical vector IFE 31. FIG. 7B shows a rear rotated view of the same parcel envelope 24 shown in FIG. 7A. Both sides are in agreement to provide for the same clue and solutions as to the location of placing and viewing information.

Figure 7E:
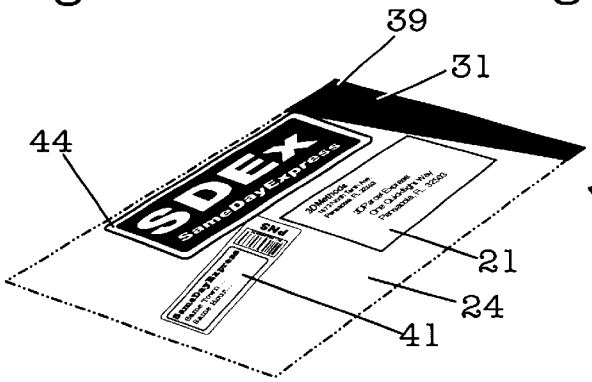
FIGS. 7E and 7F show top and bottom perspective views, respectively, of a document envelope parcel having an IFE.
Figure 7F:
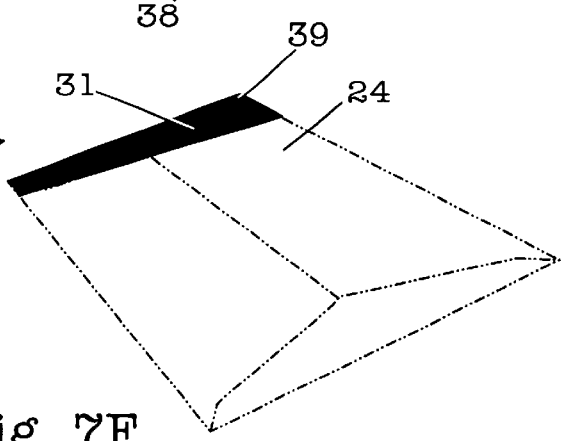

FIGS. 7E and 7F show a second example of an application of vertical vector IFE to parcel envelope 24. Here, a carrier service label 44, traditional address label 21, and a barcode label 41 for scanning to track and bill for the service event. FIG. 7F shows a bottom perspective view of the document parcel envelope 24 shown in FIG. 7E. Prior to any information being located on parcel envelope 24, either side may be designated the priority side. The person applying information therefore determines the priority location on a single side, thus enabling others to easily locate all information applied to parcel envelope 24.

Figure 4D:
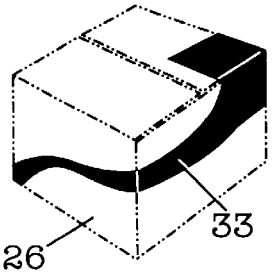
FIG. 4D shows a perspective view of an ink formed vector IFE connecting corners diagonally opposite through a box parcel with a vector having a priority corner.
Figure 4G:
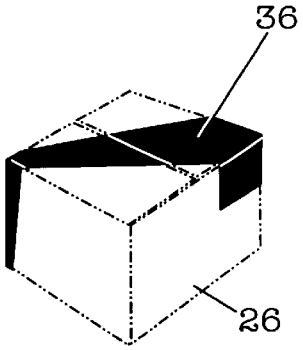
FIG. 4G shows a perspective view of an ink formed vector IFE formed on an edge and diagonally across a single side to a priority corner.
Figure 4F:
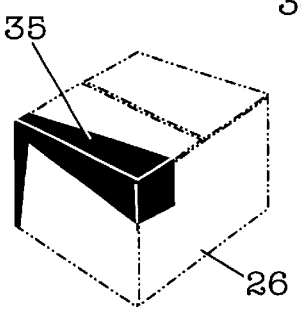
FIG. 4F shows a perspective view of an ink formed vector IFE as formed by connecting three corners having a common side.
Figure 5H:
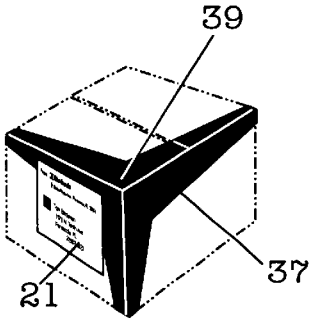
Figure 5A:
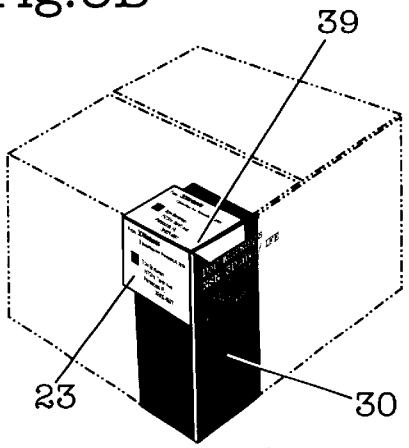
Figure 5D:
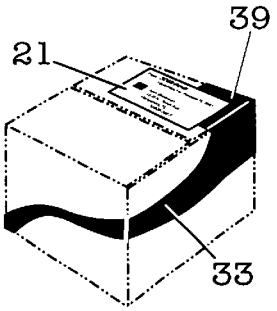
Figure 15:
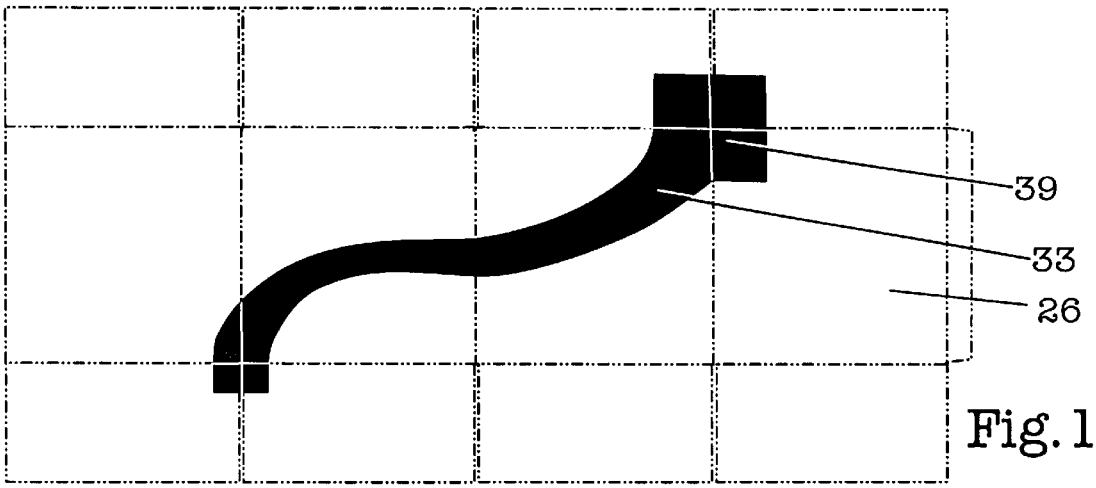

FIGS. 4D, 5D, and 15 show a parcel box 26 having a vector IFE 33 formed of ink capturing two corners across two faces and at one edge, where the corners are diagonally opposite each other through the parcel. FIG. 5D presents an exemplary application using traditional address label 21 at a priority corner on the top side of vector IFE 33. A plan view of an example of an unassembled boxes parcel 26 having a vector IFE 33 imprinted thereon is shown in FIG. 15. Vector IFE 33 appears the same regardless as to how the flaps are folded during the parcel lifecycle.

Figure 4E:
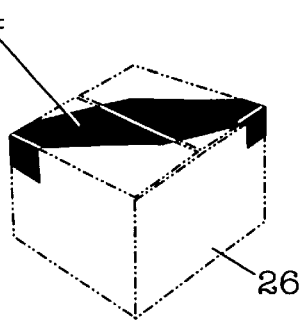
FIG. 4E shows a perspective view of a diagonal ink formed vector IFE as formed to provide priority on a single side.
Figure 5G:
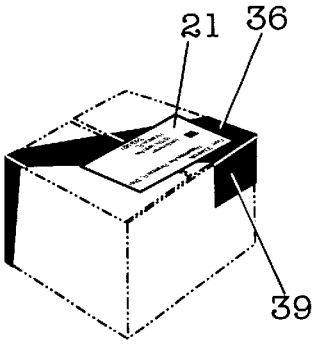
Figure 5F:
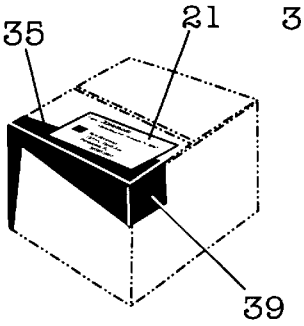
Figure 5E:
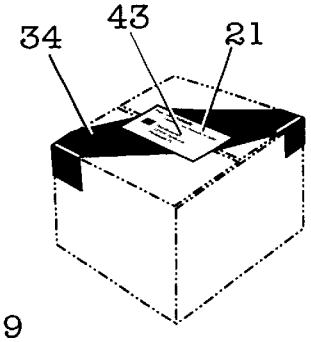
Figure 16:
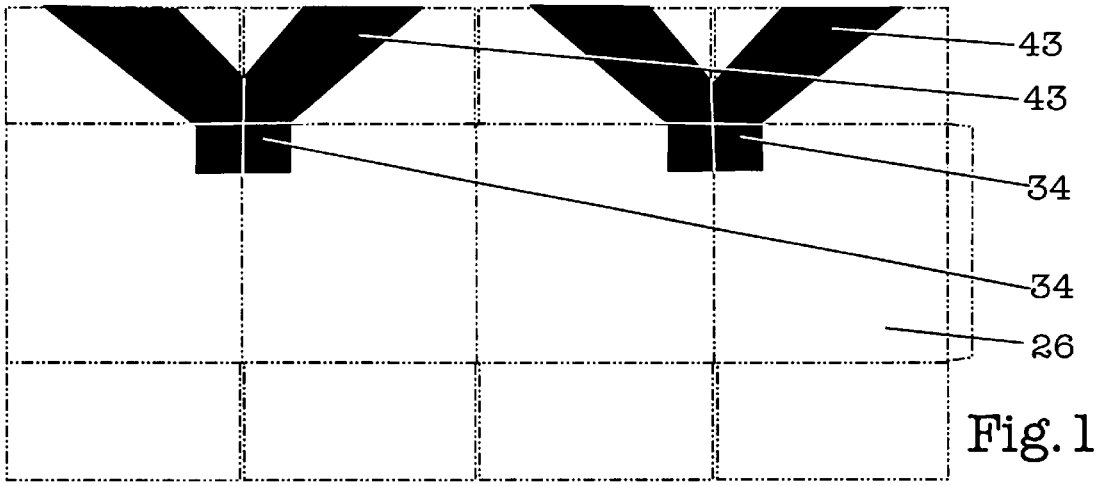

FIGS. 4E, 5E and 16 show a parcel box 26 having a diagonal vector IFE 34 formed of ink capturing two corners across a single side face of a parcel box 26. FIG. 5E presents an exemplary application using traditional address label 21 applied to the top of diagonal vector IFE 34 at priority area 43 formed thereby at the top center. A plan view of an example of an unassembled box parcel 26 having a diagonal vector IFE 34 imprinted thereon is shown in FIG. 16. Diagonal vector IFE 34 remains unchanged regardless as to how the flaps are folded during the parcel's lifecycle.

Figure 10A:
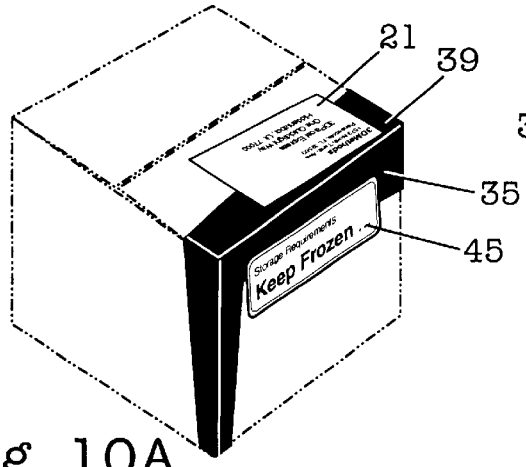
FIGS. 10A and 10B show top and bottom perspective views, respectively, of another exemplary application of the vector IFE of FIG. 4F.
Figure 10B:
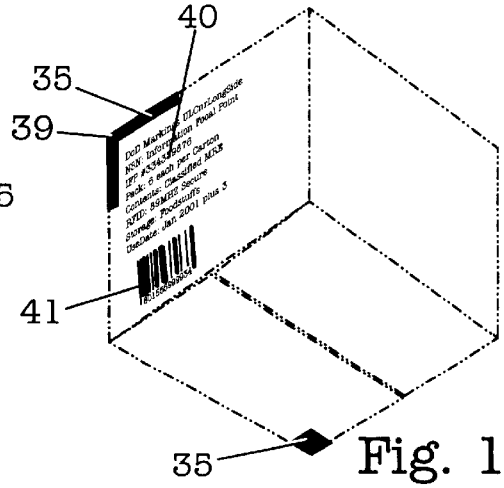
Figure 17:
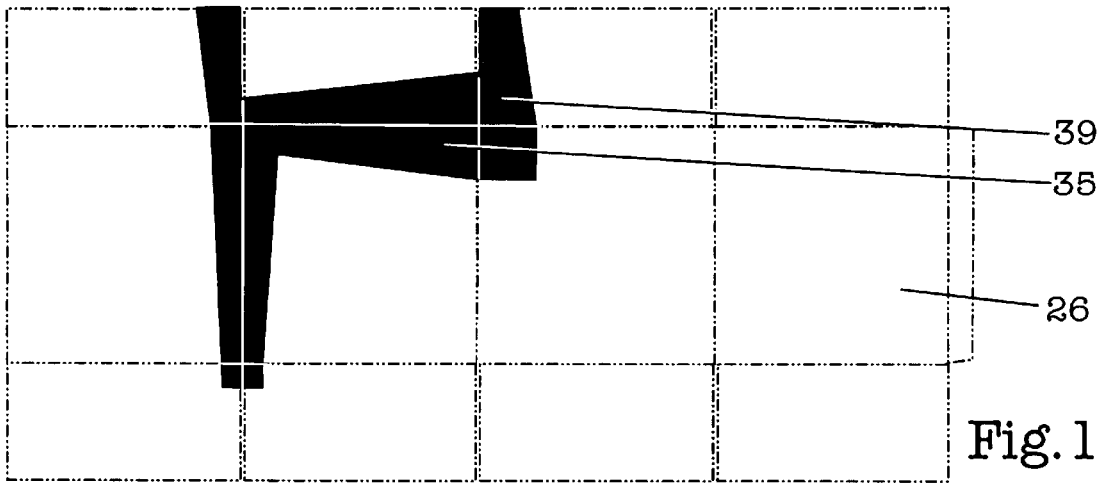

FIGS. 4F, 5F, 10A, 10B, and 17 show a parcel box 26 having vector IFE 35 formed of ink capturing three corners along two edges of on face of parcel box 26. A first exemplary application of a box parcel 26 having a vector IFE 35 is shown in FIG. 5F. Here, a traditional address label 21 is applied to the top of vector IFE 35 adjacent to priority corner 39. FIGS. 10A and 10B show another exemplary application of a box parcel 26 having a vector IFE 35 formed thereon. FIG. 10A shows a first view wherein traditional address label 21 and a handling instruction label 45 for storage requirements are applied. FIG. 10B shows a rotated perspective bottom view of the same parcel as shown in FIG. 10A. Here, exemplary ink marking 40 representing required DoD formatted information as required by contract marking regulations in the Mil. Spec 129 military guide for parcel marking in the upper left corner of the long side where in this case the layout has purposefully been constructed so that all information may be located in the priority corner 39 for easy location. A plan view of an example of an unassembled box parcel 26 having a diagonal vector IFE 34 imprinted thereon is shown in FIG. 17. Vector IFE 35 remains unchanged regardless as to how flaps are folded during the parcel lifecycle.

Figure 9A:
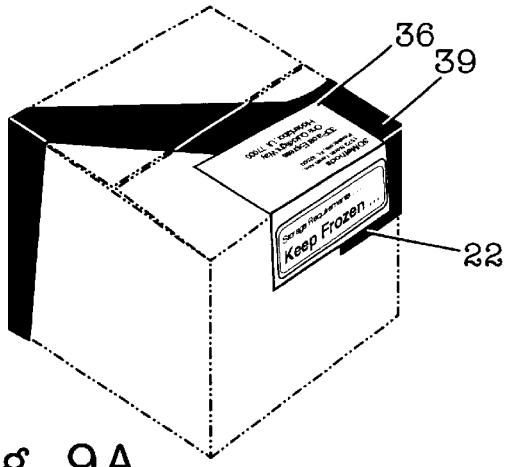
FIGS. 9A and 9B show top and bottom perspective views, respectively, of another exemplary application of the vector IFE of FIG. 4G.
Figure 9B:
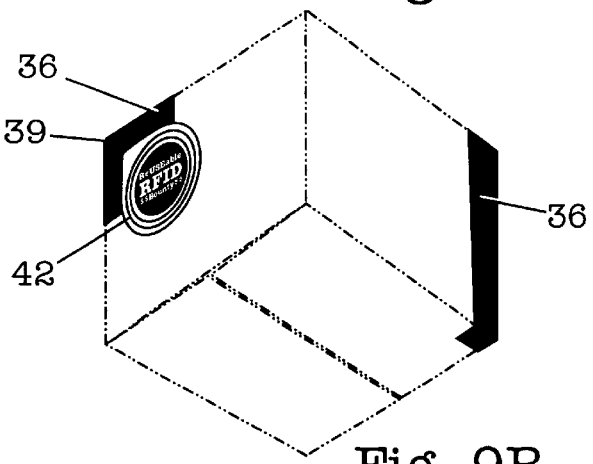
Figure 18:
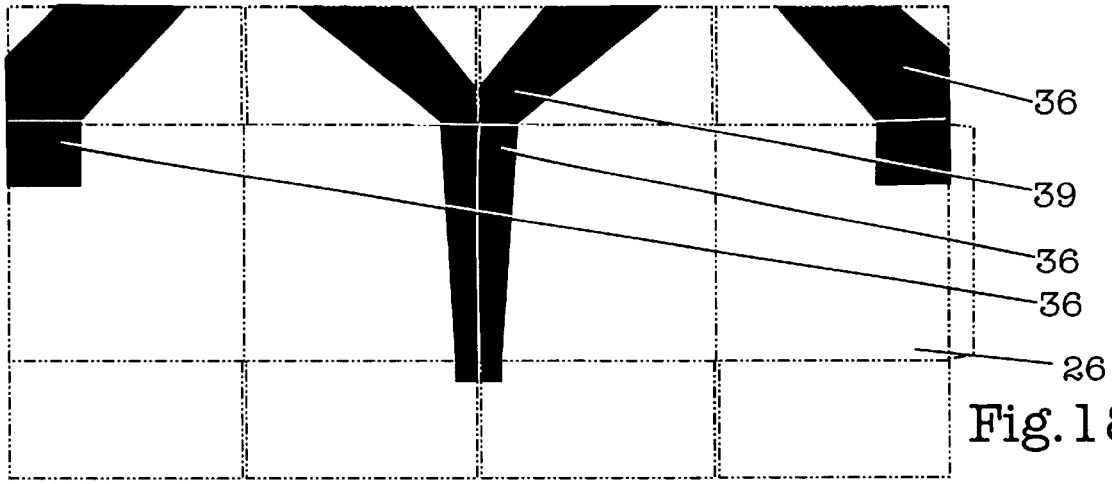

FIGS. 4G, 5G, 9A, 9B, and 18 show a parcel box 26 having a vector IFE 36 formed of ink capturing three corners by first extending along an edge and then across a side face of parcel box 26. A first exemplary application of a box parcel 26 having a vector IFE 36 is shown in FIG. 5G. Here, a traditional label 21 is applied to the top of vector IFE) 36 adjacent to priority corner 39. FIGS. 9A and 9B show another exemplary application of a box parcel 26 having a vector IFE 36 formed thereon. FIG. 9A shows a first view wherein a saddle label 22 applied over a single edge for increased visibility at priority corner 39. FIG. 9B shows a rotated perspective view of the parcel box 26 of FIG. 9A. Here, RFID 42 is adjacent to priority corner 39. A plan view of an example of an unassembled parcel box 26 having a vector IFE 36 imprinted thereon is shown in FIG. 18 where the vector remains unchanged regardless as to how flaps are folded during the parcel lifecycle.

Figure 19:
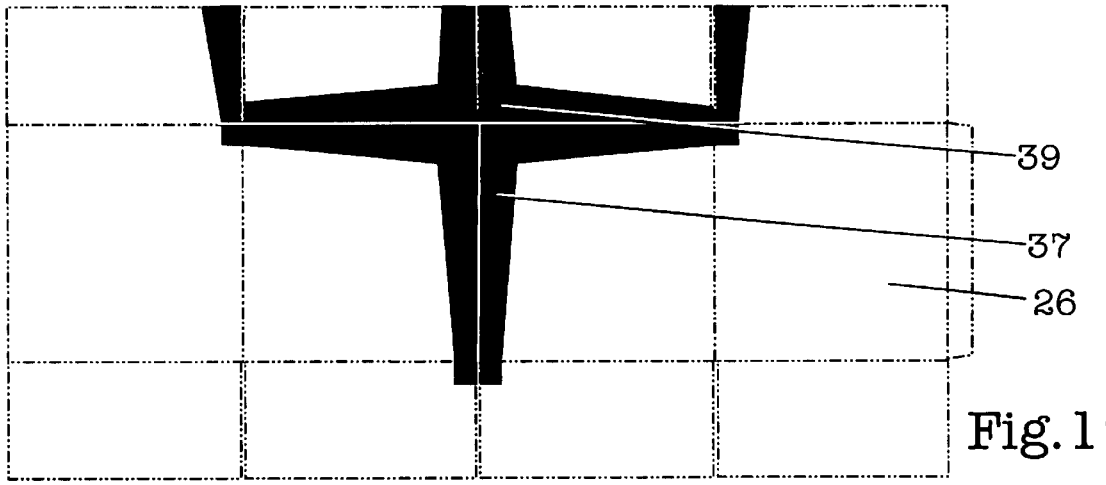

FIGS. 4H, 5H, and 19 show a parcel box 26 having a tri-vector IFE 37 formed of ink capturing four corners. It is noteworthy to point out that while this view shows a connection to corners along three edges, it is also easily accomplished by marking across the three side faces in a diagonal manner to grab the three visible and unmarked corners as an alternate embodiment. FIG. 5H shows an exemplary application of a box parcel 26 having a tri-vector IFE 37. Here, traditional label 21 is applied adjacent priority corner 39 identified by tri-vector IFE 37. A plan view of an example of an unassembled box parcel 26 having a tri-vector IFE 36 imprinted thereon is shown in FIG. 19. The tri-vector IFE remains unchanged regardless as to how the flaps are folded during the parcel lifecycle.

Figure 20:
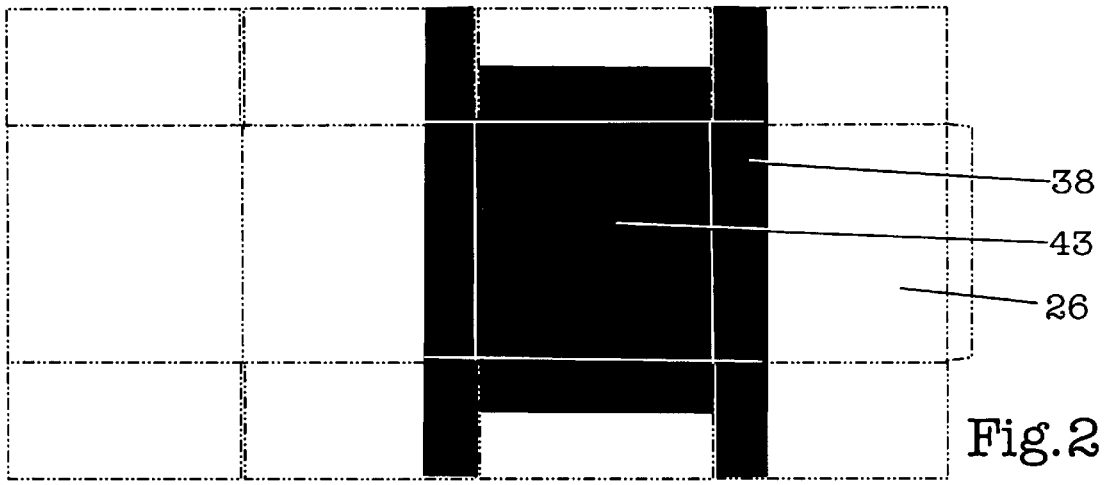

FIGS. 4I, 5I, and 20 show a parcel box 26 having an IFE 38 formed of ink capturing four corners with parallel lines and the common side and its four edges as priority area 43 for placing information. In an exemplary application, FIG. 5I shows traditional address label 21 applied to the side of IFE 38. A plan view of an example of an unassembled box parcel 26 having IFE 38 imprinted thereon is shown in FIG. 20. IFE 38 remains unchanged regardless as to how the flaps are folded during the parcel lifecycle.

Figure 7G:
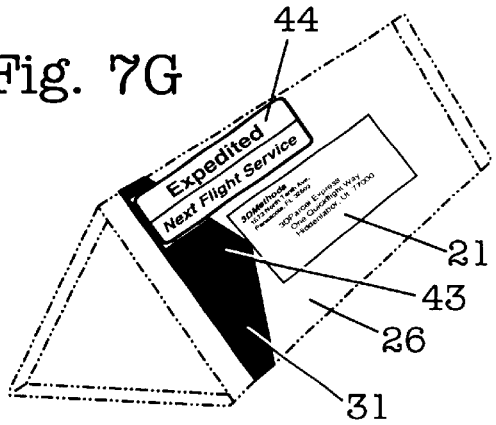
FIGS. 7G and 7H show rotated perspective views of a triangular tube parcel having a vector IFE formed of ink.
Figure 7H:
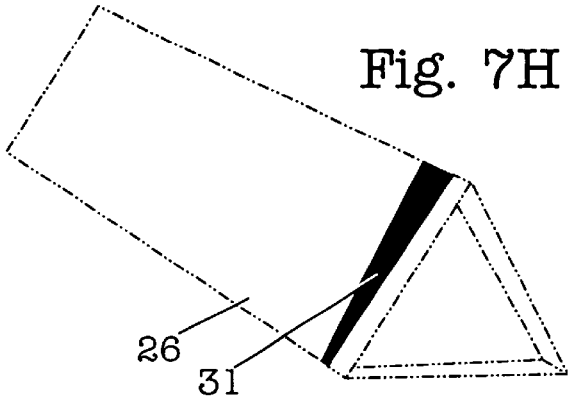
Figure 7I:
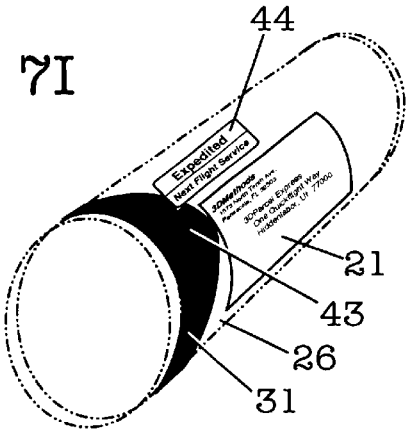
FIGS. 7I and 7J show rotated perspective views of a tube parcel having a vector IFE formed of ink.
Figure 7J:
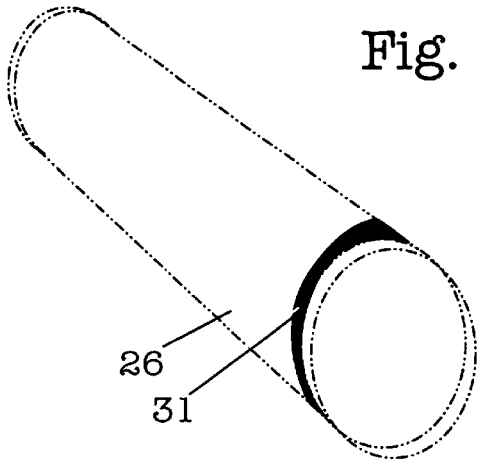

The vector IFE concept can also be applied to elongated parcels such as tubes of varying cross-section. FIGS. 7G and 7I show a first view of elongated parcels having triangular and circular cross-sections, respectively. On each, an IFE 31 vector formed of ink is imprinted on the substrate. For purposes of illustration, exemplary carrier service labels 44 and a traditional address label 21 are applied to priority area 43 on elongated parcels 26. FIGS. 7H and 7J show respectively a rotated perspective parcels 26 of FIGS. 7G and 7I.

All possible embodiments or materials according to the invention are not shown in this teaching. However, various features from different embodiments may be mixed and matched, representing the spirit of the invention. Accordingly, the scope of the invention should be determined not by the embodiments illustrated, but by the appended claims and their legal equivalents.

What is claimed is:

1. The parcel having a marking thereon for improving handling and processing of said shipping parcel, said marking connecting a first corner of said shipping parcel with a any second corner, said marking capturing said first corner and said second corner so that said marking is visible on each side of said parcel forming said first and second corners and, said marking acting to visually indicate a single priority location on said parcel.

2. The parcel of claim 1, said marking being formed by directly imprinting a substrate of said parcel.

3. The parcel of claim 1 wherein said first and second corners have a common edge, said marking further connecting said second corner to a third corner by extending said marking diagonally across a face of said parcel, said priority location being located.

4. The parcel of claim 1 wherein said marking extends diagonally across a side face of said parcel to connect said first corner and said second corner.

5. The parcel of claim 1 wherein said marking visually indicates said priority location by pointing to said priority location using a graphical pattern.

6. The parcel of claim 1, said marking visually indicates said priority location by pointing to said priority location using a varying color in a direction of the priority location.

7. The parcel of claim 1, said marking visually indicating said priority location by pointing to said priority location by having an increasing width in a direction of the priority location.

8. The parcel of claim 1, wherein said parcel is one of a box and envelope.

9. The parcel of claim 1, wherein said marking extends from said priority location to at least one additional corner of said parcel.

10. The parcel of claim 1, wherein said marking includes indicia.

11. The parcel of claim 1, wherein said marking includes instructional text to aid in comprehension of said parcel.

12. The parcel of claim 1, wherein said marking includes source identification materials of a manufacturer or shipper.

13. The parcel of claim 1, wherein said marking includes marked areas for application of labels that contain information to expedite handling, processing, and safe storage.

14. The parcel of claim 1, wherein said marking includes marked areas for application of devices that contain information to expedite handling, processing, and safe storage.

15. The parcel of claim 1, wherein said marking includes placing a label on an edge as a priority location formed by connecting corners one and corner two.

* * * * *